US006709134B2

(12) United States Patent
Wu

(10) Patent No.: US 6,709,134 B2
(45) **Date of Patent: *Mar. 23, 2004**

(54) EXTENDIBLE ASSEMBLY-TYPE LAMP SHADE STRUCTURE

(76) Inventor: Wen-Chang Wu, No. 10, Lane 191, Hsi-Hsin Street, Chung Ya Tsun, Hsiu Shiu Hsiang, Chang Hua Hsien (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/794,349

(22) Filed: Feb. 28, 2001

(65) Prior Publication Data

US 2002/0118543 A1 Aug. 29, 2002

(51) Int. Cl.[7] ..... F21V 11/00

(52) U.S. Cl. ..... 362/352; 362/311; 362/356; 362/358

(58) Field of Search ..... 362/157, 186, 362/255, 257, 277, 278, 311, 317, 351, 352, 353, 355, 356, 357, 358, 361, 367, 368, 433, 434, 450

(56) References Cited

U.S. PATENT DOCUMENTS 3,742,210 A * 6/1973 Chapman ..... 362/350
4,275,434 A * 6/1981 Borowitz ..... 362/311
4,290,099 A * 9/1981 Vicars-Harris ..... 362/352
5,375,048 A * 12/1994 Barnes ..... 362/352
6,315,434 B1 * 11/2001 Long ..... 362/352
6,517,220 B2 * 2/2003 Wu ..... 362/352

* cited by examiner

*Primary Examiner*—Alan Cariaso
*Assistant Examiner*—Ismael Negron
(74) *Attorney, Agent, or Firm*—Troxell Law Office PLLC

(57) ABSTRACT

An extendible assembly-type lamp shade structure having a top ring and a bottom ring both having appropriately situated open ends, frame members sequentially arrayed for propping between the top ring and the bottom ring, and a lamp shade fabric surfacing. The plurality of frame members each have punch formed at their bottom ends a catch section with a through-hole to provide for sleeving onto the bottom ring and, furthermore, the bottom ring has a fixing ring ensleeved at each of the two sides of the frame members that position the frame members. The top ring has sleeved onto it fixing mounts situated for each frame member that provide for the positioning of the frame members. The lamp shade fabric surfacing is positioned by the insertion of the frame members; through-holes are first made to provide for the insertion of the frame members extending from the upper aspect of the fixing mounts on the top ring and all are extended to the exterior side of the lamp shade fabric surfacing. When usage is desired, the top ring is first moved upward long the frame members until it is against the frame member top ends. As such, ease of assembly is achieved and, furthermore, storage and shipping dimensions are reduced to effectively decrease shipping costs.

1 Claim, 7 Drawing Sheets

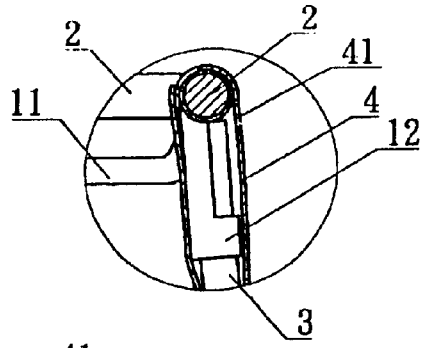
FIG4-A
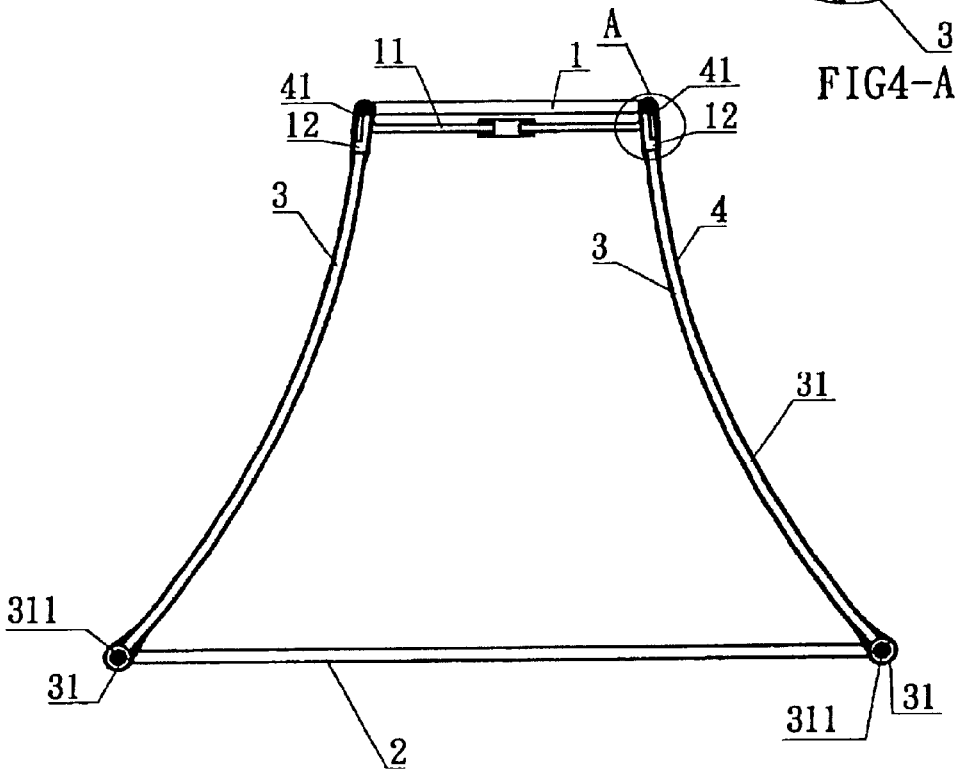
FIG4

EXTENDIBLE ASSEMBLY-TYPE LAMP SHADE STRUCTURE

BACKGROUND OF THE INVENTION

1. Field of the Invention

The invention herein relates to an extendible assembly-type lamp shade structure comprised of frame members each having punch formed at their bottom ends a catch section with a through-hole to provide for sleeving onto a bottom ring and, furthermore, the bottom ring has a fixing ring ensleeved at each of the two sides of the frame members that position the frame members; a top ring which has sleeved onto it fixing mounts situated for each frame member that provides for the insertion and positioning of the frame members; a lamp shade fabric surfacing positioned by the insertion of the frame members and in which through-holes are first made to provide for the insertion of the frame members extending from the upper aspect of the fixing mounts on the top ring and all are extended to the exterior side of the lamp shade fabric surfacing; when usage is desired, the top ring is first moved upward along the frame members until it is against the frame member top ends; as such, ease of assembly is achieved and, furthermore, storage and shipping dimensions are reduced to effectively decrease shipping costs.

2. Description of the Prior Art

A conventional lamp shade 5, referring to FIG. 7, typically has its frame members permanently fixed between the top ring and the bottom ring to form a lamp shade structure; however, since its structure is imperfect, the numerous practical shortcomings that result and await further correction and improvement by the industry are represented by the following example.

Since the conventional lamp shape 5 is a structural entity of an unyielding shape, when it is packaged in a carton, the lamp shade 5 cannot be forcefully diminished in size and no reduction in large volume storage area is possible, which leads to a proportional increase in product shipping costs and results in greater overhead.

In view of the said shortcomings, the inventor of the invention herein conducted extensive research that culminated in the successful development of the invention herein.

SUMMARY OF THE INVENTION

The primary objective of the invention herein is to provide an extendible assembly-type lamp shade structure comprised of a top ring, a bottom ring, frame members, and a lamp shade fabric surfacing, wherein the plurality of frame members each have punch formed at the bottom end a catch section with a through-hole to provide for sleeving onto the bottom ring and, furthermore, the bottom ring has a fixing ring ensleeved at each of the two sides of the frame members that position the frame members; the top ring has sleeved onto it fixing mounts situated for each frame member that provide for the insertion and positioning of the frame members; the lamp shade fabric surfacing is positioned by the insertion of the frame members and in which through-holes are first made to provide for the insertion of the frame members extending from the upper aspect of the fixing mounts on the top ring and all are extended to the exterior side of the lamp shade fabric surfacing; when usage is desired, the top ring is first moved upward along the frame members until it is against the frame member top ends; as such, ease of assembly is achieved and, furthermore, storage and shipping dimensions are reduced to effectively decrease shipping costs.

To enable the examination committee a further understanding of the present invention, the brief description of the drawings below are followed by the detailed description of the invention herein.

BRIEF DESCRIPTION OF THE DRAWINGS

FIG. 2-A is magnified view of the fixing mount.

FIG. 2-B is a magnified view of the frame member and bottom ring assembly.

FIG. 4 is a cross-sectional drawing of the invention herein illustrating the enshrouded lamp shade fabric surfacing.

FIG. 4-A is an enlarged view of area A in FIG. 4.

DETAILED DESCRIPTION OF THE INVENTION

Figure 1:
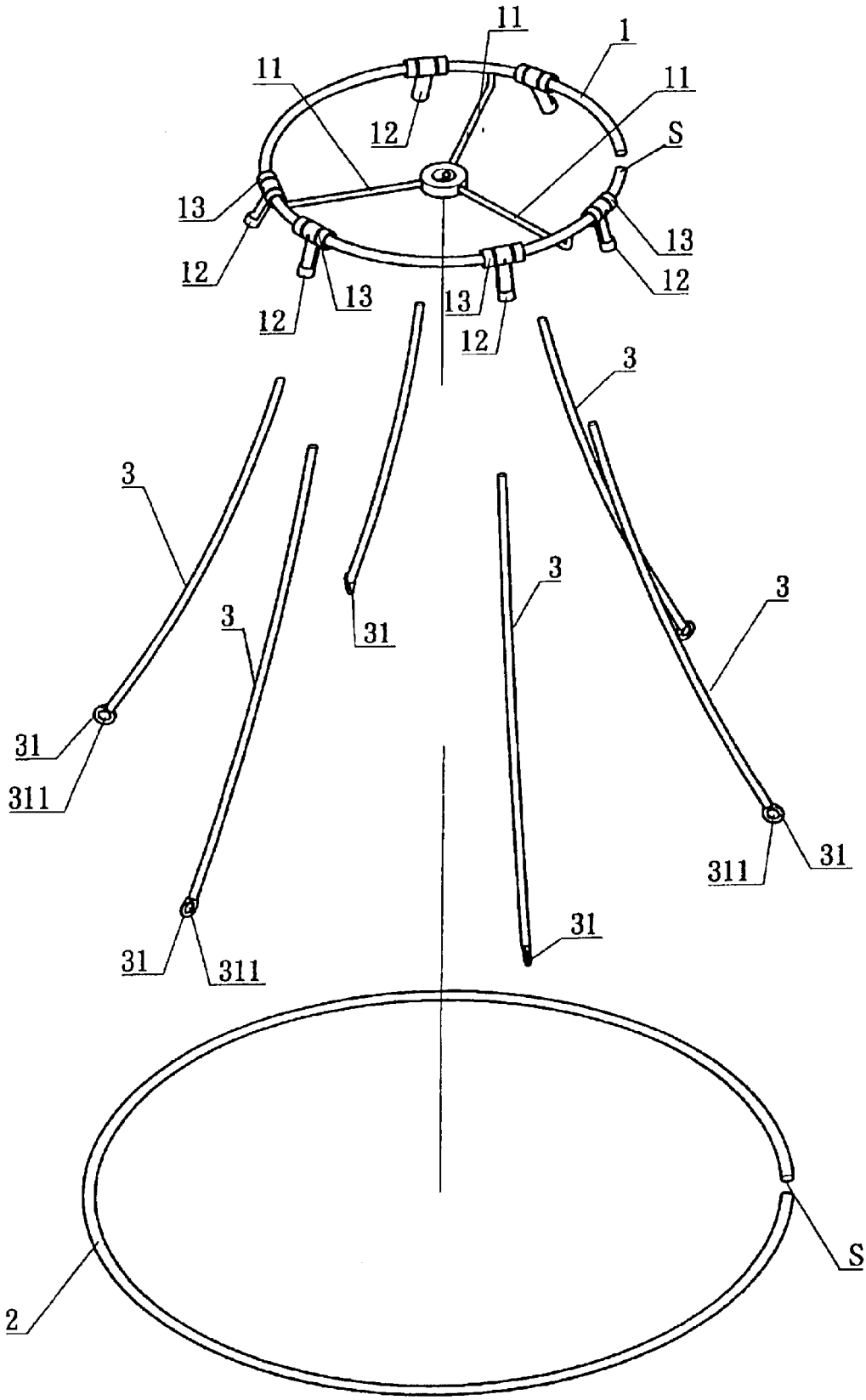
FIG. 1 is an exploded drawing of the frame member section of the invention herein.
Figure 2:
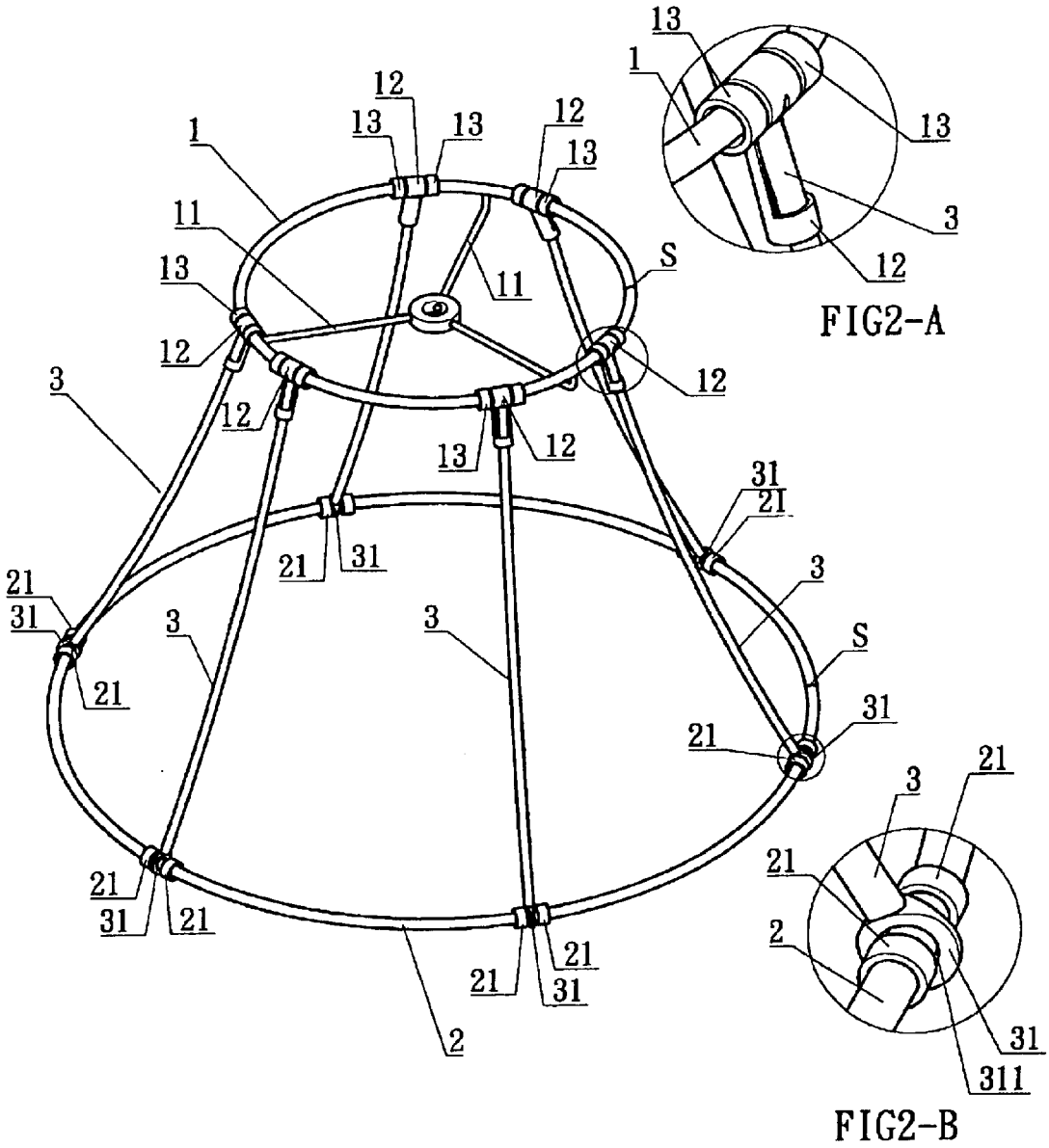
FIG. 2 is an isometric drawing of the frame member section of the invention herein.

Referring to FIG. 1, FIG. 2, FIG. 3, FIG. 4, and FIG. 5, drawings depicting the structural arrangement of the present invention, the invention herein is comprised of a top ring 1 and a bottom ring 2 both having appropriately situated open ends S, frame members 3 sequentially arrayed for propping between the top ring 1 and the bottom ring 2, and a lamp shade fabric surfacing 4 enshrouding the outer periphery of the frame members 3, wherein:

The said top ring 1 is of annular metal construction and, furthermore, is situated on the columnar lamp pipe structure, with the top ring 1 having support rods 11 extending from the center towards its circumference; the said top ring 1 has sleeved onto it fixing mounts 12 for each frame member 3 that provide for the positioning and insertion of the frame members 3 and, furthermore, sleeved at each of the two sides of the fixing mounts 12 is a fixing ring 13 that restricts the leftward and rightward movement of the fixing mounts 12, following which the open ends S of the top ring 1 are welded together.

Of larger diameter than the top ring 1, the said bottom ring 2 has open ends S situated at an appropriate location and, furthermore, the open ends S provide for insertion into the frame members 3; ensleeved at each of the two sides of the frame member 3 catch sections 31 are fixing rings 21 that position the frame members 3 by limiting the movement of the frame members 3, following which the open ends S of the bottom ring 2 are welded together.

Each of the said frame members 3 have continuously punch molded at their bottom ends a flat catch section 31 and, furthermore, the catch section 31 is punched into a round shape as the punch molding progresses, and a through-hole 311 is punched through the center of the catch section 31 to provide for sleeving onto the bottom ring 2.

Figure 5:
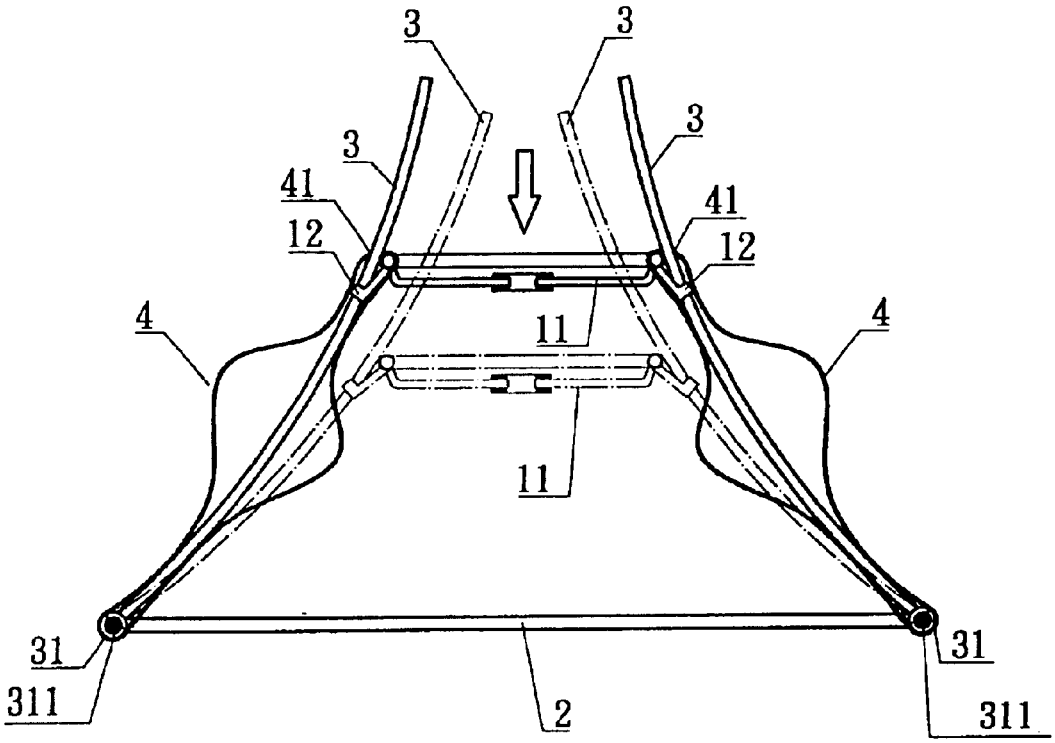
FIG. 5 is a cross-sectional drawing of invention herein in a semi-folded state.

The said lamp shade fabric surfacing 4 is positioned by the insertion of the frame members 3; through-holes 41 are first made to provide for the insertion of the frame members 3 extending from the upper aspect of the fixing mounts 12 on the top ring 1 and, while still in a folded state, they are all extended to the exterior side of the lamp shade fabric surfacing 4 (as shown in FIG. 5).

Figure 3:
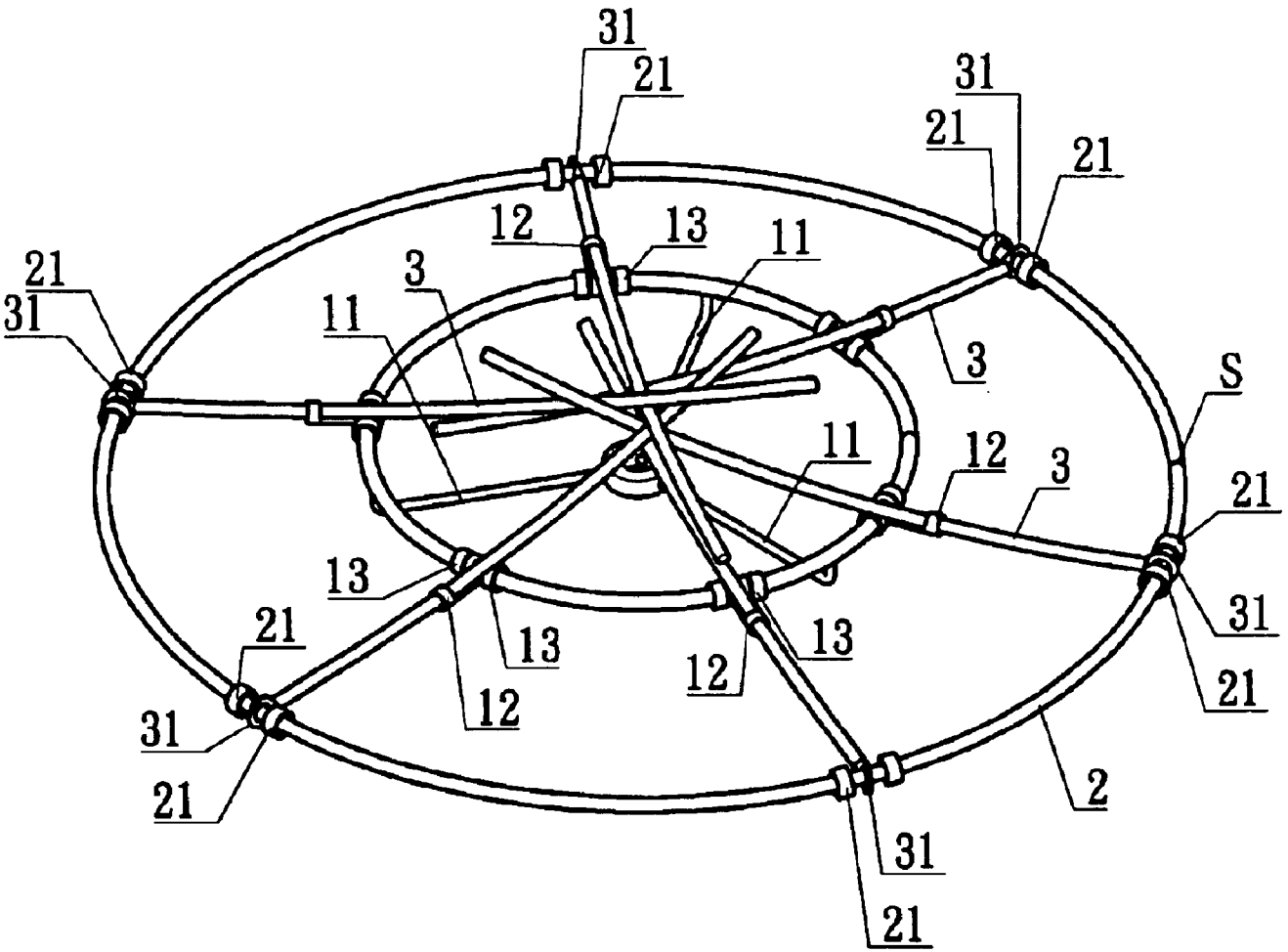
FIG. 3 is an isometric drawing of the frame members in the folded state.

Referring to FIG. 3, FIG. 4, and FIG. 5, since the said lamp shade is not being used, the frame members 3 extend from the upper aspect of the top ring 1 such that the lamp shade fabric surfacing 4 can be folded flat, with the top ring 1 and the bottom ring 2 situated in the same plane and the frame members 3 postured crisscross in a level configuration (as shown in FIG. 3), thereby enabling the assembly of the lamp shade in the smallest possible physical space, while also reducing storage and shipping dimensions; when usage is desired, the lamp shade bottom end is pushed against the top ring 1 such that the top ring 1 is pushed along the frame members 3 towards the frame member 3 top ends until the top ring 1 and the bottom ring 2 stop are stopped at the top and bottom ends (as shown in FIG. 4); as such, ease of assembly is achieved and, furthermore, storage and shipping dimensions are reduced to effectively decrease shipping costs.

Figure 6:
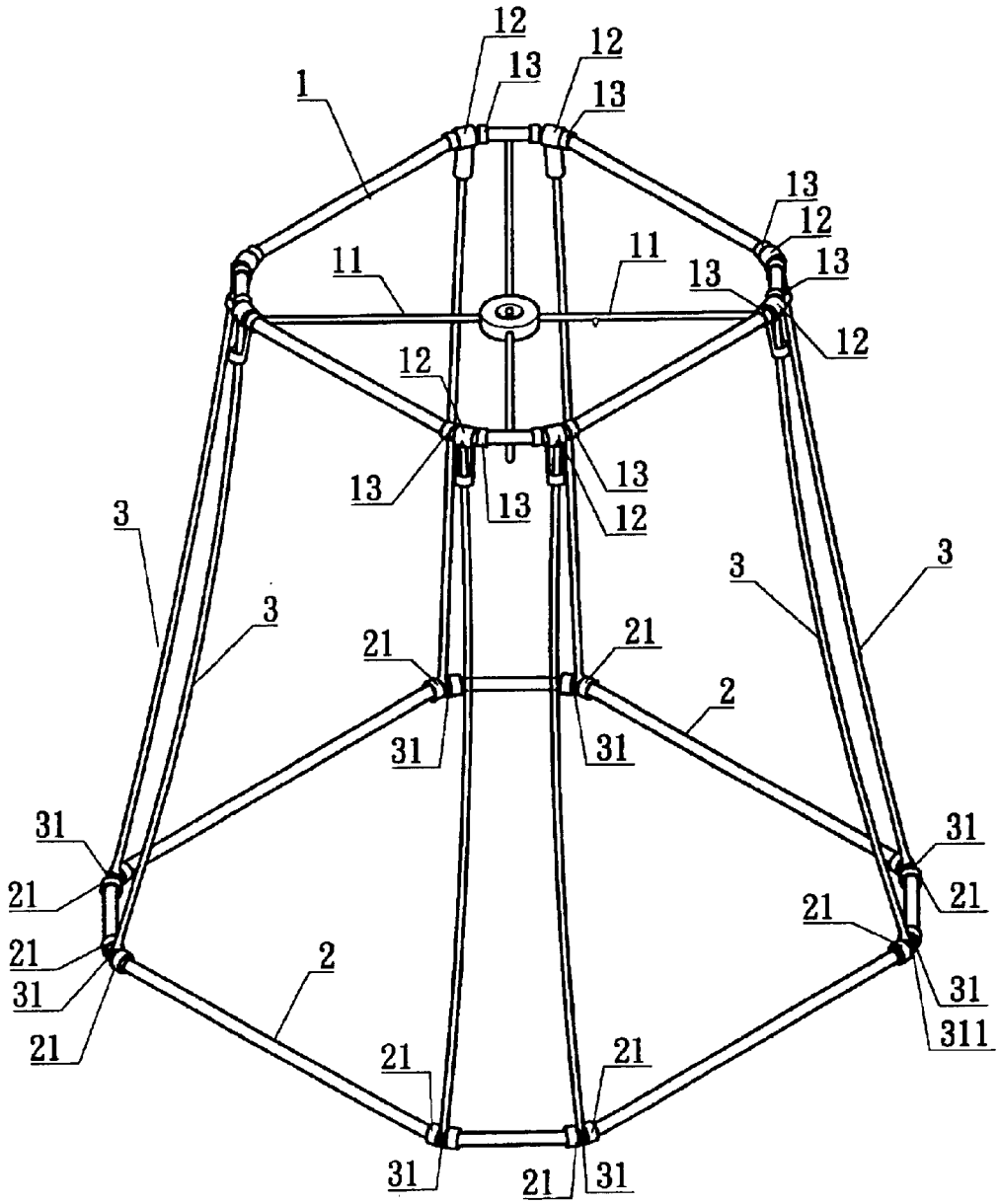
FIG. 6 is an isometric drawing of another embodiment of the invention herein.
Figure 7:
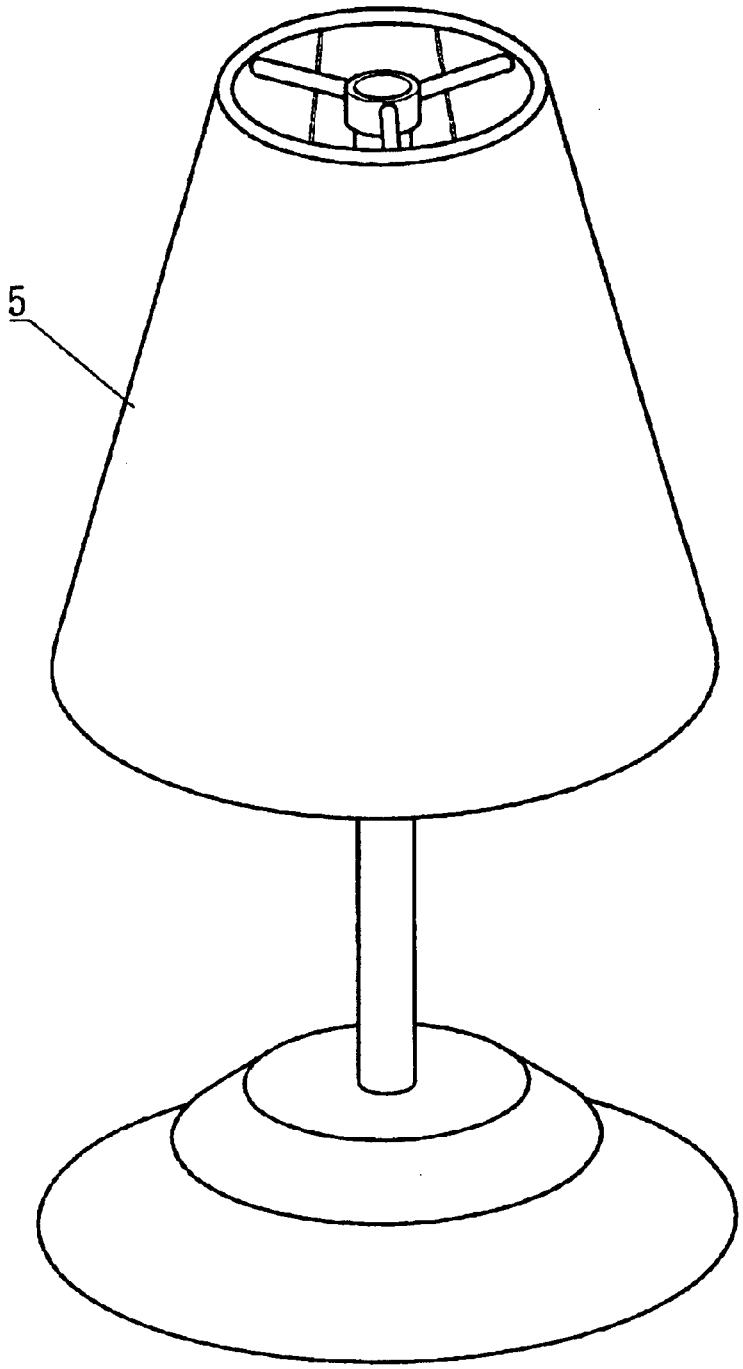
FIG7 PRIOR ART
FIG. 7 is an isometric drawing of a conventional lamp shade.

Referring to FIG. 6, the drawing of another embodiment of the invention herein, the said embodiment is of a nearly rectangular structural arrangement, which demonstrates that the lamp shade of the invention herein can be fabricated in a range of different shapes.

I claim:

1. An extendible lamp shade comprising:

a) a top ring having a plurality of support rods;

b) a plurality of fixing mounts pivotally connected to the top ring, each fixing mount having two opposite sides;

c) a plurality of first fixing rings mounted on the top ring, one first fixing ring located at each opposite side of each fixing mount to restrict sideways movement of the fixing mounts relative to the top ring;

d) a bottom ring;

e) a plurality of single piece frame members, each single piece frame member having a first end with an integral, flattened catch section having a through hole, through which the bottom ring passes so as to pivotally attach the frame members to the bottom ring, each single piece frame member having a second end removably connected to one of the plurality of fixing mounts; and, f) a plurality of second fixing rings mounted on the bottom ring, one second fixing ring located on each opposite side of the catch section of each single piece frame member to restrict sideways movement of the single piece frame members relative to the bottom ring.

* * * * *